US006839927B1

(12) United States Patent
Crane

(10) Patent No.: US 6,839,927 B1
(45) Date of Patent: Jan. 11, 2005

(54) NECK AND HEAD HAMMOCK INCLUDING COMPARTMENTS AND VARYING SUPPORTS

(75) Inventor: Nicholas Jack Crane, Redwood City, CA (US)

(73) Assignees: Nicholas J. Crane, Redwood City, CA (US); International Innovations, Redwood City, CA (US)

( * ) Notice: Subject to any disclaimer, the term of this patent is extended or adjusted under 35 U.S.C. 154(b) by 0 days.

(21) Appl. No.: 10/623,852

(22) Filed: Jul. 22, 2003

(51) Int. Cl.[7] ..... A47C 20/06
(52) U.S. Cl. ..... 5/643; 5/640; 5/639
(58) Field of Search ..... 5/636, 639, 640, 5/643

(56) References Cited

U.S. PATENT DOCUMENTS 2,197,343 A * 4/1940 Marx ..... 5/640
2,502,752 A * 4/1950 Richards ..... 5/640
2,551,388 A * 5/1951 Nygard ..... 5/640
3,002,201 A * 10/1961 Nelson et. al. ..... 5/640
3,263,246 A * 8/1966 Towery ..... 5/639
3,981,032 A * 9/1976 Brooks ..... 5/639
4,688,286 A * 8/1987 Miker, Jr. ..... 5/490
5,515,564 A * 5/1996 Lyons ..... 5/639
5,918,332 A * 7/1999 Dees ..... 5/639
6,154,904 A * 12/2000 Ehredt ..... 5/639

* cited by examiner

*Primary Examiner*—Michael Trettel

(57) ABSTRACT

A portable and collapsible neck and head hammock including compartments (30) with varying supports to support the neck and head. Embodiments include adjustable and varying supports as seen in (FIGS. 7,8,9) which can include uneven fabric panels as seen in (FIG. 7), bottom arms are shorter than the top arms as seen in (FIG. 8), and by removing and replacing the panel dowels in the desired multiple panel adapters as seen in (FIG. 9). The present invention, in one embodiment is a neck and head hammock with at least one pocket as seen in (FIGS. 1, 2 and 3). Multiple species of the neck and head hammock (30) are created which all include at least one pocket/compartment (47,50,51). These compartments may be used by placing the item through the opening of the compartments (52,53,54) or waterproofed by attaching a zipper (55) as seen in (FIGS. 1 and 2) to protect the stored items.

Other Embodiments of the invention include multiple compartments (47,50,51) allowing storage of miscellaneous items as seen in (FIGS. 1,2,3). Another embodiment of the present invention uses the compartment to create a neck and head massager (48) as seen in (FIG. 1). Another embodiment includes specialized pockets to create and hold a head massager (48) which can be replaced with a cold/gel pack.

19 Claims, 3 Drawing Sheets

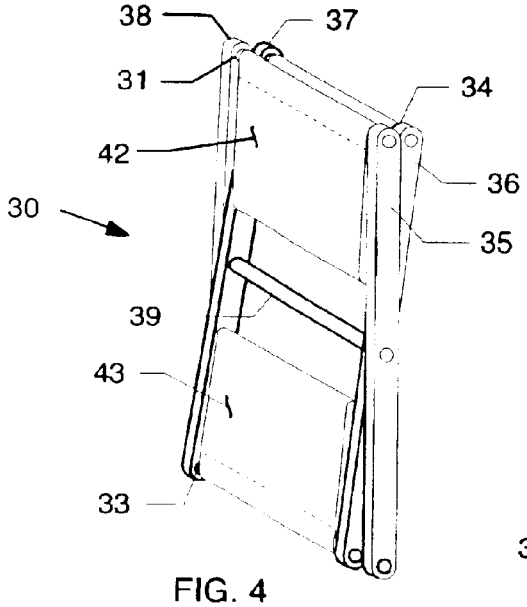
FIG. 4
FIG. 5
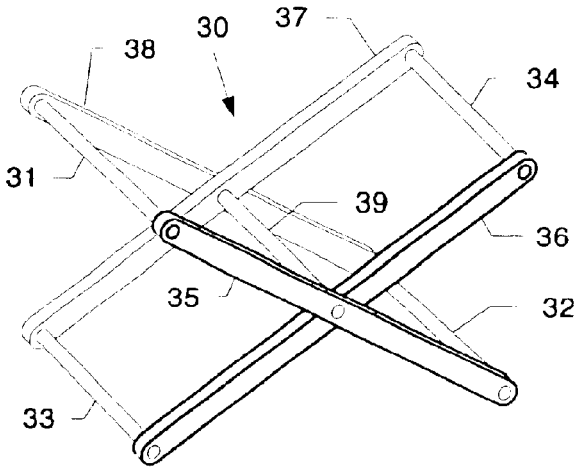
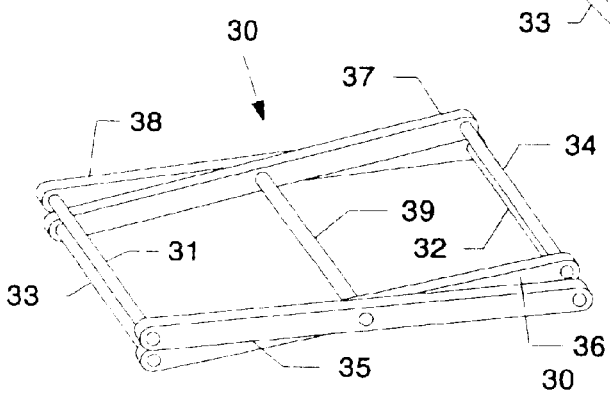
FIG. 6
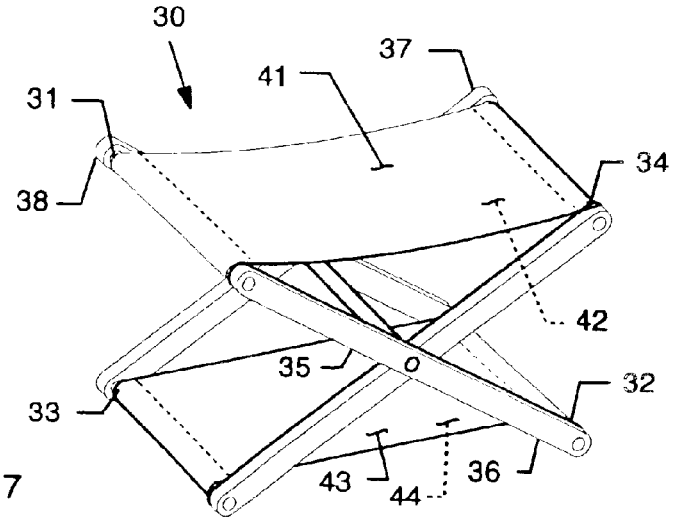
FIG. 7

NECK AND HEAD HAMMOCK INCLUDING COMPARTMENTS AND VARYING SUPPORTS

FEDERALLY SPONSORED RESEARCH

Not Applicable

SEQUENCE LISTING OR PROGRAM

Not applicable

BACKGROUND

Field of Invention

The present invention relates to a means of supporting the neck and head in a laying position. Currently people have had the option to use headrests at the beach mentioned in U.S. Pat. No. 4,544,203. However U.S. Pat. No. 4,544,203 only discloses one type of headrest. While this headrest achieves its objectives as a means to support the head, it only starts to scratch the surface of possibilities and leaves open a wide area for new inventions in regards to its function, cost and for usability. For example people typically use the head rests at the beach or in the open air, and often do not have or want to use their own pockets to store valuables, like keys, cell phone, etc. while sun bathing. My invention allows the user to store their personal belongings safely and securely. The neck and head hammock including compartments in which I have invented is large enough to support both the neck and head. I have invented a basic simple neck and head hammock with varying supports and compartments that can be manufactured at a low cost. Prior art headrests are collapsible, and are essentially fixed, These head rests are non-adjustable structures that a user cannot configure or adjust as desired for comfort ability. Embodiments of my present invention substantially fulfill these needs. The structure of the prior art is a non-adjustable fixed structure; this poses a problem for the fact that humans come in many shapes and sizes. Adjustability is needed to provide multiple supports so the user of any size can be comfortable.

These current headrests have no compartments; My present invention includes compartments which enable the user safe storage of miscellaneous items, These encased items are securely stored below the users head to avoid theft or misplacement. Theft is a worry as the suns-rays often cause sleepiness or temporary blindness, and; many thieves are on the prowl waiting for that unsuspected moment.

In another embodiment the advantage of the invention is waterproof compartments, which will encase a cell phone, originally the previous option was to lay your cell phone or personal belonging's close by, possibly on a towel or in a purse. The inconveniences included the cell phone or personal becoming wet and/or damaged by a large wave or spillage of a beverage. Sand also can have undesirable results on personal items especially electronic devices. In regards to electronic devices short circuits and stuck buttons are prone to sand and liquid penetration.

Another previous approach many individuals choose to use is a bed type pillow to sunbath. This type of pillow is not suited for beach. Sand mites and sand soon creep through the material. Another so-called form of a head support is to bundle up loose articles of clothing to support the head. The user bundles up articles of clothing and/or shoes and places them under their head. This can cause soreness of the neck and only leaves the used articles with wrinkles.

We need to face the fact, that many people do not bring a chair or lounge product with them, while sunbathing. The reason for this includes the size and inconvenience of transporting the devices. A solution is definitely needed for a device that is easily transportable, serves a purpose, can massage and/or cool the neck and head, and stores items such as a cell phone, car key's, money,' or other miscellaneous items deterring theft. Many people, every year, flock to the beach to relax and sunbath. Now they can enjoy themselves, receive a tan and receive a massage at the same time, while holding, personal items securely underneath their head. My invention is a great means for relaxation. And will be easy to transport. My invention also includes a dowel going thru the center arm, which can be used as a handle to transport the item, even when the pockets are in use.

In light of the foregoing, a need exists in the art for neck and head hammocks including compartments that provide compartments to store personal belongings; a need further exists for neck and head hammocks including compartments that are configurable/adjustable. Embodiments of the present invention substantially fulfill these needs. The object in which my invention accomplishes is an easy way of relaxing in the open air. Further objects and advantages of my invention will become apparent from a consideration of the drawing and ensuing description of the device.

SUMMARY OF THE INVENTION

The present invention is a multi functional collapsible Neck and Head hammock including compartments with adjustable and varying supports. In one embodiment, the present invention is a collapsible neck and head hammock with at least one pocket or compartment to store personal items, Another embodiment is a specialized pocket to hold a massager, to create a neck and head hammock that massages the users neck and head. Other embodiments of the invention provide collapsible head hammocks that provide varying and adjustable neck an head support, to provide advanced user controlled supports. This can be seen as in FIGS. 7,8,9. Another embodiment of the structure is declared in U.S. Pat. No. 4,544,203 Both structures or similar structures can be used to from the embodiments of my invention. The compartments can be configured on one panel or both. The opening can be opened and sealed by the user. The compartments can be waterproof compartments to protect the personal belongings encased within the pockets. The pockets can be used to hold a, cell phone, money, keys and other personal belongings. These compartments can be made from one layer of material attached to the panel, or the pocket can be made from two layers and attached to the panel. A compartment with a built in or attached massager is introduced which can also be removed and replaced with a gel/ice pack to sooth the neck and head. The neck and head hammock including compartments is adjustable, comprising of varying fabric and leg lengths. Adjustable dowels, which support the panels, are also incorporated to achieve the desire support required by the user. All of the above adjustable structures can be combined to create different support options.

DRAWING FIGURES

In the drawings, closely related figures have reference numbers but different alphabetic suffixes. FIGS. 1 through 11 show the embodiment consisting of the neck and head hammock with components. The foregoing advantages of this invention will become more readily appreciated as the same becomes better understood by references to the following detailed description, when taken into conjunction with the accompanying drawings, wherein;

FIG. 4 shows a perspective view of the Neck and Head hammock including compartments in its collapsed and closed transporting position. The middle dowel is used as a handle to carry the neck and head hammock to its desired location.

FIG. 5 shows a perspective view of the Neck and Head hammock including compartments showing the first, second, third and fourth connecting arms, connected to the 2 long dowels and 2 short dowels and the middle dowel.

FIG. 6 shows a perspective view of the Neck and Head hammock including compartments comprising of the first, second, third and fourth connecting arms, connected to the 2 long dowels and 2 short dowels and the middle dowel.

FIG. 7 shows a perspective view of the Neck and Head hammock including compartments wherein the top panel is longer than the bottom.

REFERENCE NUMERALS IN DRAWINGS

Figure 1:
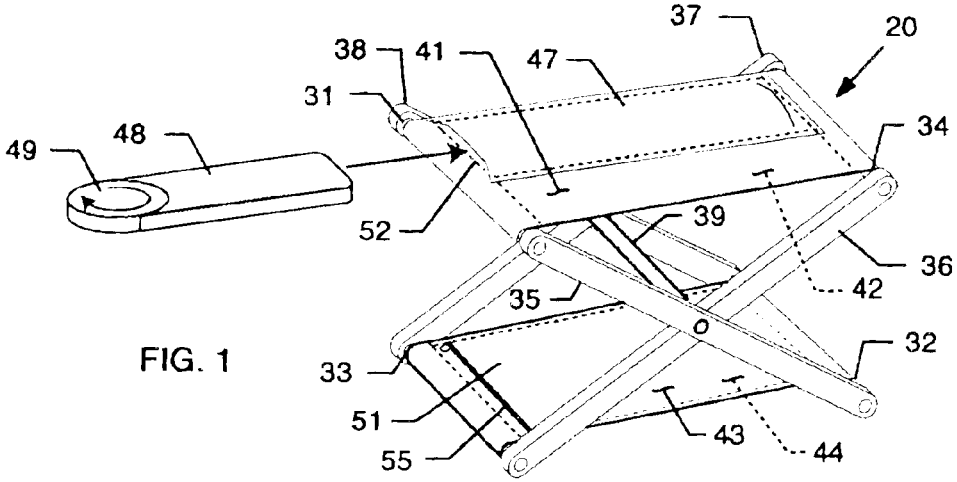
FIG. 1 shows a perspective view of the Neck and Head hammock including compartments how it is attached to the upper top panel.

30 A neck and head hammock including compartments
31 left upper long dowel
32 right bottom long dowel
33 left bottom short dowel
34 right upper short dowel
35 First connecting arm
36 Second connecting arm
37 Third connecting arm
38 Fourth connecting arm
39 long dowel connecting first, second, third, and fourth connecting arms multiple panel adapters
41 upper/top panel
42 upper/bottom panel
43 bottom/top panel
44 bottom/bottom panel
45 small dowel connecting first and second connecting arms
46 small dowel connecting third and fourth connecting arms
47 massage unit/compartment
48 massager
49 massager setting
50 compartment/pocket
51 compartment/pocket
52 opening of compartment 47
53 opening of compartment 50
54 opening of compartment 51
55 a zipper

DETAILED DESCRIPTION OF THE PREFERRED EMBODIMENT

While we will show multiple embodiments of the invention, it will be apparent to those skilled in the art that the invention may be embodied still otherwise without departing from the spirit and scope of the claimed invention.

Figure 2:
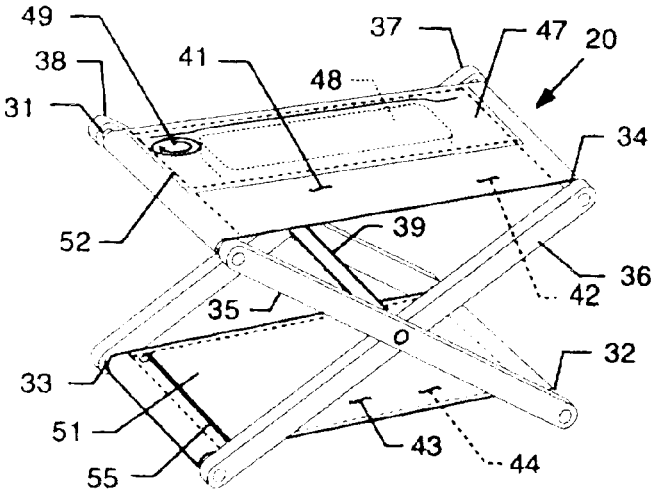
FIG. 2 shows a perspective view of the Neck and Head hammock including compartments showing the neck and head massager built into the upper top panel.

The present invention pertains to a Neck and Head hammock including compartments 30. The user simply unfolds the neck and head hammock including compartments 30 as seen in (FIG. 2). The neck and head hammock including compartments 30 supports the users neck and head. The neck and head hammock including compartments 30 assembly comprises of four connecting arms 35,36,37,38. These first, second, third and fourth connecting arms 35,36, 37,38 have three consistent holes throughout each connecting arm. These holes are located equally on both ends of the first, second, third, and fourth connecting arms 35,36,37,38 and in the middle of the first, second, third, and fourth connecting arms 35,36,37,38. We then cross and connect the first and second connecting arms 35,36 forming a x shape. Then we cross and connect the third and fourth connecting arms 37,38 forming an x shape. We then place a long dowel 39 thru the middle of the first and second connecting arms 35,36 and connect it to the third and fourth connecting arms 37,38 leaving a distance between the first pair of first and second connecting arms 35,36 and the second pair of third and fourth connecting arms 37,38. As seen in (FIG. 5) When the first, second, third, and fourth connecting arms 35,36, 37,38 are collapsed to a parallel position, the neck and head hammock including compartments 30 is flat so it can be easily transported. The user can carry the neck and head hammock including compartments 30 by fisting or holding the middle dowel 39 to achieve a means of stability when transporting the neck and head hammock including compartments 30 to its desired destination. As seen in (FIGS. 4 and 6).

A first, second, third and fourth connecting side arms 35,36,37,38 grouped into 2 sets of 2 pairs of substantially straight arms. We then attach the left portion of upper panel 41,42 by inserting a left upper long dowel 31 thru the end of the left side of the upper panel 41,42. Then we insert the left upper long dowel 31 thru the top hole of the first and fourth connecting arms 35,38. Then we attach the right portion of the upper panel 41,42 by inserting a right upper short dowel 34 thru one end of the right side of the upper panel 41,42. Then we insert the right upper short dowel 34 thru the top holes of the second and third arms 36,37 forming an upper panel 41,42 with lengths traveling from the top left side of the neck and head hammock including compartments 30 to the upper right side of the neck and head hammock including compartments 30 to support the users neck and head in a desired position. We then attach the left portion of the bottom panel 43, 44 by inserting a left bottom short dowel 33 thru the end of the left side of the bottom panel 43,44 Then we insert the left bottom short dowel 33 thru the bottom hole of the second and third connecting arms 36,37. Then we attach the right portion of the bottom panel 43,44 by inserting a right bottom long dowel 32 thru one end right side of the bottom panel 43,44. Then we insert the right bottom long dowel 32 thru the bottom holes of the first and fourth connecting arms 35,38 forming a lower panel 43,44 with lengths traveling from the bottom left side of the neck and head hammock including compartments 30 to the bottom right side of the neck and head hammock including compartments 30 as seen in (FIG. 2).

Embodiment #1 Shows a Version of the General Utility Compartments for the Neck and Head Hammock Including Compartments.

A neck and head hammock including compartments 30 wherein at least one pocket is attached to the panels 41,42, 43,44 that span between the collapsible first, second, third and fourth connecting arms 35,36,37,38. The pockets/compartments 50, 51 as seen in (FIG. 3) have multiple objectives such as holding personal belongings one might bring to the beach. Simply slide the item into one of the compartments 47,50,51, thru the openings 52,53,54 as seen in (FIG. 1). By having compartments 47,50,51 attached, within, or to the panels 41,42,43,44 the device underneath the head serves as a security device that will hold safely and securely personal belongings within the neck and head hammock including compartments 30 while deterring theft. As seen In (FIGS. 1 and 2) we can see that the bottom compartment has a zipper 55. This enables the personal belongings inside the compartment 51 to become a closeable compartment 51. In (FIG. 3) we show the compartment 51 with an opening 54. Here the user simply slides the personal belonging thru the opening 54 to secure the items.

Figure 3:
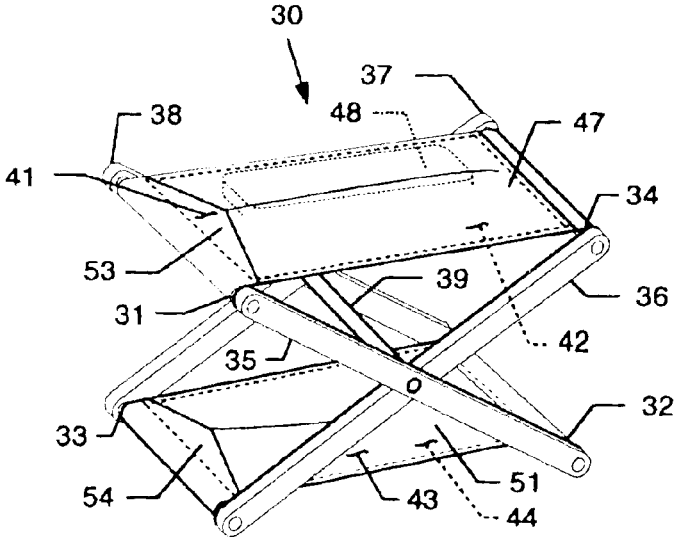
FIG. 3 shows a perspective view of the Neck and Head hammock including compartments showing the panel pocket and the bottom/top pocket and their openings.

Embodiment #2 Shows a Version of the Massager with 2 Units and Specially Adaptable Pockets A neck and head hammock including compartments 30 with a massager 48 and a massaging unit/compartment 47 connected to one of the upper panels 41, 42. A permanent or attachable massager 48 and massager unit/compartment 47 is constructed into the upper panels 41,42 of the neck and head hammock including compartments 30 as seen in (FIG. 2) or can be attached separately by sliding the massager 48 into the left opening 52 of the massager unit/compartment 47 as seen in (FIG. 1). This massager 48 is stored in compartment 47. The massager 48 can be removed and replaced at any time and serve as a utility pocket as in compartments 50,51 as seen in (FIG. 1) when the massaging unit/compartment 47 is vacant. The massager 48 can also be built into compartment 50 located on the bottom top panel 42 as seen in (FIG. 3). The size of the massage unit/compartment 47 is large enough to hold miscellaneous items. Therefore the massager unit/compartment 47 is specially adaptable or can be used as a generalized pocket 50,51. Compartments 50, 51 function as storage compartments to hold misc. items and can be secured with a zipper 55 as seen in (FIGS. 1 and 2), or an open able or foldable slit or opening 52,53,54 as seen in (FIG. 3). To start the massager 48 turn the massager setting 49 on the massager 48 in either a clockwise or counter clockwise motion to configure desired speed setting. To stop the massager 48, reverse the turning action on the setting 49 by turning the setting 49 in the opposite direction as seen in (FIG. 1 and FIG. 2).

Embodiment #3 Shows a Version of the Neck and Head Hammock Including Compartments in which the Compartment can be a Water Proof Compartment.

A neck and head hammock including compartments 30 wherein the compartments 47,50,51 can be made of waterproof materials as seen on the bottom/top panel 43 can have a zipper 55 to create a water proof compartment 43 as seen in (FIGS. 1 and 2). In fact the entire neck and head hammock including compartments 30 can be made of a waterproof material. The material can be made out of any material that is waterproof. The compartment openings 52,53,54 can also be waterproof zippers 55. Water proofing the neck and head hammock including compartments 30 will allow security for the items encased in the compartments 47,50,51 so they do not become damaged by unforeseen circumstances such as a large wave, or spillage of beverages.

Embodiment #4 Shows a Neck and Head Hammock Including Compartments where One of the Panels is Longer than (or Looser than) the Other.

A neck and head hammock including compartments 30 where one of the panels is longer than (or looser than) the other, as seen in (FIG. 7). Having varying lengths of panels 41,42,43,44 will cause a different support. The longer the panels 41,42,43,44 lengths the more soft it is for the user. The shorter the panels 41,42,43,44 the more firm the panel becomes as seen in (FIG. 7). Flip the neck and head hammock including compartments 30 upside down to choose between the two supports.

Embodiment #5 Shows a Neck and Head Hammock where the Top Arms are Longer than the Bottom Arms.

Figure 8:
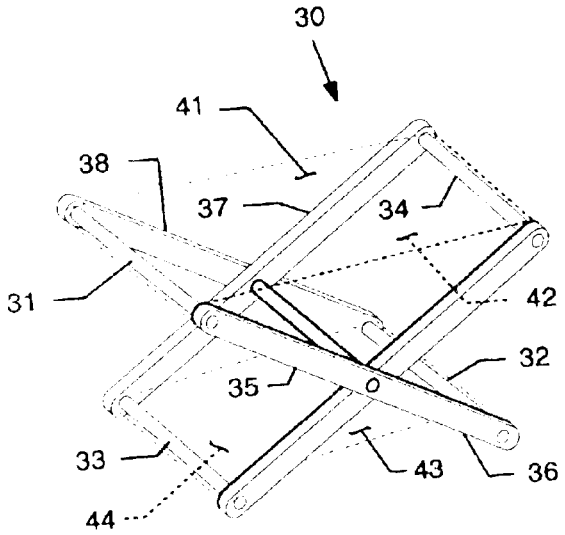
FIG. 8 shows a perspective view of the Neck and Head hammock including compartments wherein the bottom first, second, third and fourth connecting arms, are shorter than the top first, second, third and fourth connecting arms.

A neck and head hammock including compartments 30 where the top first, second, third, and fourth connecting arms 35,36,37,38 are longer than the bottom first, second, third, and fourth connecting arms 35,36,37,38 while keeping the upper panels 41,42 dimensions the same but changing the length of the bottom panels 43,44 between the four arms 35,36,37,38. On the bottom panels 43,44 of the first, second, third, and fourth connecting arms 35,36,37,38 the panels 43,44 will be shorter resulting in a firmer neck and head hammock including compartments 30 as seen in (FIG. 8). Flip the neck and head hammock including compartments 30 upside down to choose between the different supports.

Embodiment #6 Shows a Neck and Head Hammock Including Compartments where the Panel Dowels are Adjustable on Both Sets of Arms to Achieve Desired Support.

Figure 9:
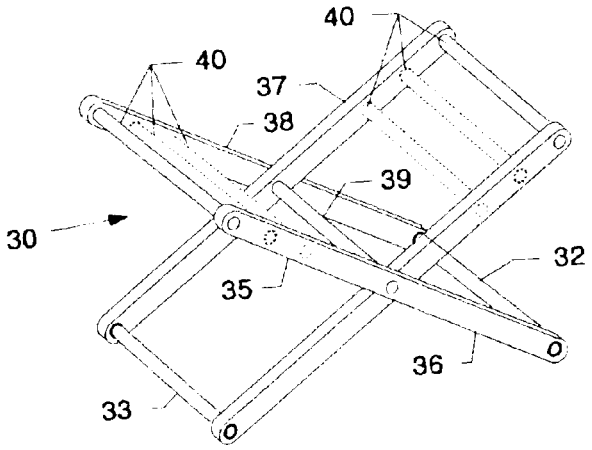
FIG. 9 shows a perspective view of the Neck and Head hammock including compartments showing that the top panel dowels can be manually adjusted by removing and replacing the panel dowels in the desired multiple panel adapters.

A neck and head hammock including compartments 30 where the top first, second, third, and fourth connecting arms 35,36,37,38 have multiple adapters 40 wherein the top panel dowels 31,34 can be interchanged to acquire desired support. As seen in (FIG. 9).

Figure 10:
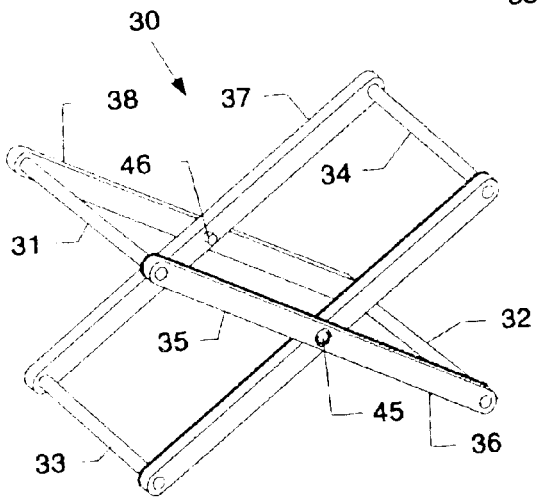
FIG. 10 shows a perspective view of the Neck and Head hammock including compartments wherein there are 2 small dowels connecting the first, second, third and fourth connecting arms.

Embodiment #7 Shows a Neck and Head Hammock Including Compartments where the Middle Connecting Dowel is 2 Small Dowels A neck and head hammock including compartments 30 where the long dowel 39 is actually comprised of 2 small dowels 45,46. One small dowel 45 connects the first, second connecting arms 35,36. And the second small dowel 46 connects the third and forth connecting arms 37,38. As seen in (FIG. 10).

Thus the reader can see that the product provides a highly reliable, lightweight, and multiple purpose convenient devices that can be used by persons of almost any age. While my above description contains a specification, these should not be construed as limitations on the scope of the invention, but rather as an exemplification of multiple embodiments thereof. Many other variations are possible. For example:

The neck and head hammock can be:

- Changed in size (made smaller or larger)
- Made of any material (i.e. wood, plastic, etc.)
- Made of a different shape
- Made of a different color The massager can be:

- Located on the top/bottom/back/front portion or inside the material of the product May vary in size May vary in speeds Can be built in, attached and or removed The massager setting can be:

Placed wherever is convenient to the controller

The compartments can be:

Made of any type of material.

Water Proof

Prevent sand and water from entering

The Frames can be made of the following:

Any size

Different sizes and lengths

Any length

Any material

The panels can be made of the following:

Any length

Any Width

Any Material

The compartments can be closed by tucking the material or secured and closed with the following:

Zipper

Water proof zipper

Velcro

Ziploc

The compartments can be located anywhere on the material and can include:

Multiple pockets

Pockets on the left, right side or middle of the material or all

Hold the miscellaneous items when collapsed

I claim:

1. A collapsible neck and head hammock including compartments comprising:

a) first, second, third and fourth connecting side arms grouped into two sets of crossed pairs of substantially straight arms forming a first pair of pivotally attached arms and a second pair of pivotally attached arms, each pair of arms forming a cross member shape connecting to dowels to form a support frame, b) first, second, third, and fourth dowels extending through and connecting said first and second pair of substantially straight arms at the ends thereof to pivotally attach the first set of straight arms to the second set of straight arms, c) a fifth dowel extending through and connecting a central middle portion of both pairs of said straight arms to form said pivot between said pairs of arms, d) each said set of said straight arms having a portion thereof being spaced apart by said dowels, e) a first fabric panel having ends, one end being connected to said first dowel and the other end connected to said second dowel, and f) a second fabric panel having ends, one end being connected to said third dowel and the other end connected to said fourth dowel, and g) said panels being of uneven lengths so that when said pair of arms are in an opened and spread position, said first panel is firm while said second panel is less firm than the first panel.

2. The collapsible neck and head hammock including compartments of claim 1, further comprising a pocket attached to the first fabric panel.

3. The collapsible neck and head hammock including compartments of claim 1, further comprising 2 pockets attached to the first fabric panel.

4. The collapsible neck and head hammock including compartments of claim 1 further comprising a pocket attached to the second fabric panel.

5. The collapsible neck and head hammock including compartments of claim 1 wherein the pocket is an enclosable pocket.

6. The collapsible neck and head hammock including compartments of claim 1 including a pocket wherein the pocket is open from an inner surface of a first fabric portion attached to the first fabric panel.

7. The apparatus of claim 2 wherein the pocket is an enclosable pocket.

8. The collapsible neck and head hammock including compartments of claim 2 further comprising at least one massaging unit located in the pocket.

9. The collapsible neck and head hammock including compartments of claim 8 wherein the at least one massaging unit is an electrical vibrator.

10. The collapsible neck and head hammock including compartments of claim 2 further comprising a gel pack located in the pocket.

11. The collapsible neck and head hammock including compartments of claim 2 wherein the pockets are made to be water proof.

12. A collapsible neck and head hammock, comprising:

(a) a first frame having upper and lower ends and connecting side arms, (b) a second frame having upper and lower ends and connecting side arms, wherein the connecting side arms are connected to the connecting side arms of the first frame, (c) a first panel having ends, one end being connected to said first frame upper end and the other end connected to said second frame upper end, (d) a second fabric panel having ends, one end being connected to said first frame lower end and the other end connected to said second frame lower end, and (e) said panels being of a length so that when said frames are in said opened position, said fabric panels will be substantially taut, and a pocket wherein the pocket is open from an inner surface of the first fabric attached to the first fabric panel.

13. The apparatus of claim 12 wherein the pocket is an enclosable pocket.

14. The collapsible neck and head hammock of claim 12 further comprising at least one massaging unit located in the pocket.

15. The collapsible neck and head hammock of claim 14 wherein the at least one massaging unit is an electrical vibrator.

16. The collapsible neck and head hammock of claim 12 further comprising a gel pack located in the pocket.

17. An collapsible neck and head hammock, comprising:

(a) a first rectangular frame having upper and lower parallel ends and connecting parallel side legs, (b) a second rectangular frame having upper and lower parallel ends and connecting parallel side legs, wherein the connecting parallel side legs are pivotally connected to the connecting parallel side legs of the first rectangular frame, (c) a first fabric panel having ends, one end being connected to said first frame upper end and the other end connected to said second frame upper end, (d) a second fabric panel having ends, one end being connected to said first frame lower end and the other end connected to said second frame lower end, and (e) said panels being of a uneven lengths so that when said frames are in said opened position, said first fabric panel is taut while said second panel is less taut.

18. The collapsible neck and head hammock of claim 17, further comprising a pocket attached to the first fabric panel.

19. The collapsible neck and head hammock of claim 18 wherein the pocket is an enclosable pocket.

* * * * *